US005810679A

United States Patent [19]

Yoakum

[11] Patent Number: 5,810,679

[45] Date of Patent: Sep. 22, 1998

[54] RECREATIONAL DEVICE

[76] Inventor: Paul E. Yoakum, 1365 Cooper Dr., Naples, Fla. 34103

[21] Appl. No.: 909,784

[22] Filed: Aug. 12, 1997

[51] Int. Cl.[6] ..... A63B 63/08

[52] U.S. Cl. ..... 473/472; 473/479

[58] Field of Search ..... 473/470, 472, 473/476, 479, 481, 483, 415; 273/398, 400, 401, 402, 100, 101

[56] References Cited

U.S. PATENT DOCUMENTS

| | | | |
|---|---|---|---|
| 532,132 | 1/1895 | Zaremba | 273/400 |
| 2,580,799 | 1/1952 | Lauterbach | 473/476 |
| 3,602,505 | 8/1971 | Friend | 473/470 |
| 4,482,157 | 11/1984 | McNeil | 473/470 |
| 4,611,812 | 9/1986 | Morrison | 273/400 |

*Primary Examiner*—William H. Grieb
*Attorney, Agent, or Firm*—Woodard, Emhardt, Naughton, Moriarty & McNett

[57] ABSTRACT

A recreational device which is designed for shooting baskets with a selected game ball includes a support structure consisting of a telescoping support column, four support arms which are assembled into the support column, an adapter for fixing the orientation of the support arms, and a base for positioning and stabilizing the support column relative to the ground. In addition to the support structure the recreational device includes a basket which is positioned at an elevated level and which includes an annular hoop and a net connected to the hoop in a conventional fashion. The four support arms are attached to the annular hoop for support. A manually operated adjustment ring is provided for changing the length of the support column and thereby enabling the user to set the desired height for the basket. The recreational device provides all the features of a basketball goal without the use of a backboard. Consequently, shots may be taken from a complete 360 degree pattern with the basket located at the center of that circular pattern and all shots are therefore unobstructed by any structure such as a backboard.

4 Claims, 9 Drawing Sheets

RECREATIONAL DEVICE

BACKGROUND OF THE INVENTION

The present invention relates in general to recreational devices which can be enjoyed by a variety of individuals in a variety of settings. More specifically the present invention relates to a basketball-type recreational game which provides a full 360 degree access to the basket.

The game of basketball, although enjoying great popularity throughout the world, has certain limitations which restrict where the game can be played and by whom. The actual or complete game necessitates a court, two basketball goals, at least five players on each team, and preferably a referee. Since individuals have expressed an interest in playing one-on-one, or at least some number less than a full complement, single goal games similar to basketball have sprung up on playgrounds, in back yards, in driveways, and in similar outdoor locations. Typically these single goal games are played in areas where there is enough surrounding area or land for one or more players but typically fewer than five on a side. While ten players could conceivably play with one goal, that is typically not what occurs with individual pick up games and individual practice.

A conventional basketball goal includes a backboard and a basket which includes an attached rim with a suspended net. The rim may or may not include a break away feature. Typically the backboard is positioned at the end or edge of the playing area because no play is permitted from behind the backboard. A basketball going over the top of the backboard is considered to be out of play. The presence of a backboard, although effectively limiting play to a 180 degree arc extending from the rear of the rim, enables deflections and bank shots. The use of a backboard gives errant shots a chance of going through the basket by bouncing off the backboard and deflecting into the basket. If the backboard was limited from a goal, it would force players to focus more on the accuracy of their shots which would have to be made directly at the basket rather than to the side of the basket. Without a backboard there is no chance for a shot to bank off and be deflected into the basket. If the shot is off line or too long, it will simply not go in the basket if the backboard is eliminated. While the elimination of the backboard might create certain difficulties to the present day game of basketball, the elimination of the backboard is a great teaching aid as it forces more accurate shot making. Without a backboard, shots can be taken from a full 360 degree circle with the basket at the center of this circle. The elimination of the backboard also means that there will not need to be any post or superstructure to support the backboard. However, there would be a need to somehow support the basket because without the backboard there is nothing for the rim to be attached to as is now the case. In order to be able to utilize a basketball basket without a backboard, the present invention has been conceived. A support structure is provided by the present invention which supports a basket and permits shots anywhere from within a 360 degree circle surrounding the basket. The support structure is designed to be used in a variety of locations, such as at the beach, on a playground, on a paved surface, in a school gymnasium, or in a swimming pool. The overall device of the present invention is light weight, may be easily disassembled and reassembled at any remote site, and provides an interesting challenge not heretofore available. The use of plastic or PVC materials permits use of the invention without regard to issues of corrosion or weight and provides a safer device.

SUMMARY OF THE INVENTION

A recreational device for use in cooperation with a selected game ball according to one embodiment of the present invention comprises a support structure constructed and arranged in an upright orientation with a first end to be positioned adjacent ground level and a second, opposite end to be positioned at an elevated location above the ground level and a basket having an annular hoop which is attached to the second, opposite end so as to permit unobstructed shooting directions with the selected ball toward the hoop from any location around the hoop.

One object of the present invention is to provide an improved recreational device.

Related objects and advantages of the present invention will be apparent from the following description.

DESCRIPTION OF THE PREFERRED EMBODIMENT

Figure 1A:
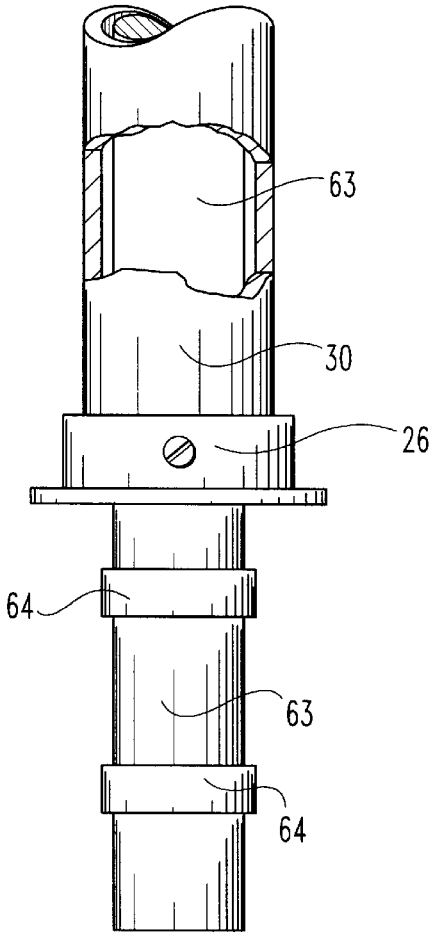
FIG. 1A is a partial, perspective view of the FIG. 1 recreational device with an alternative base design.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
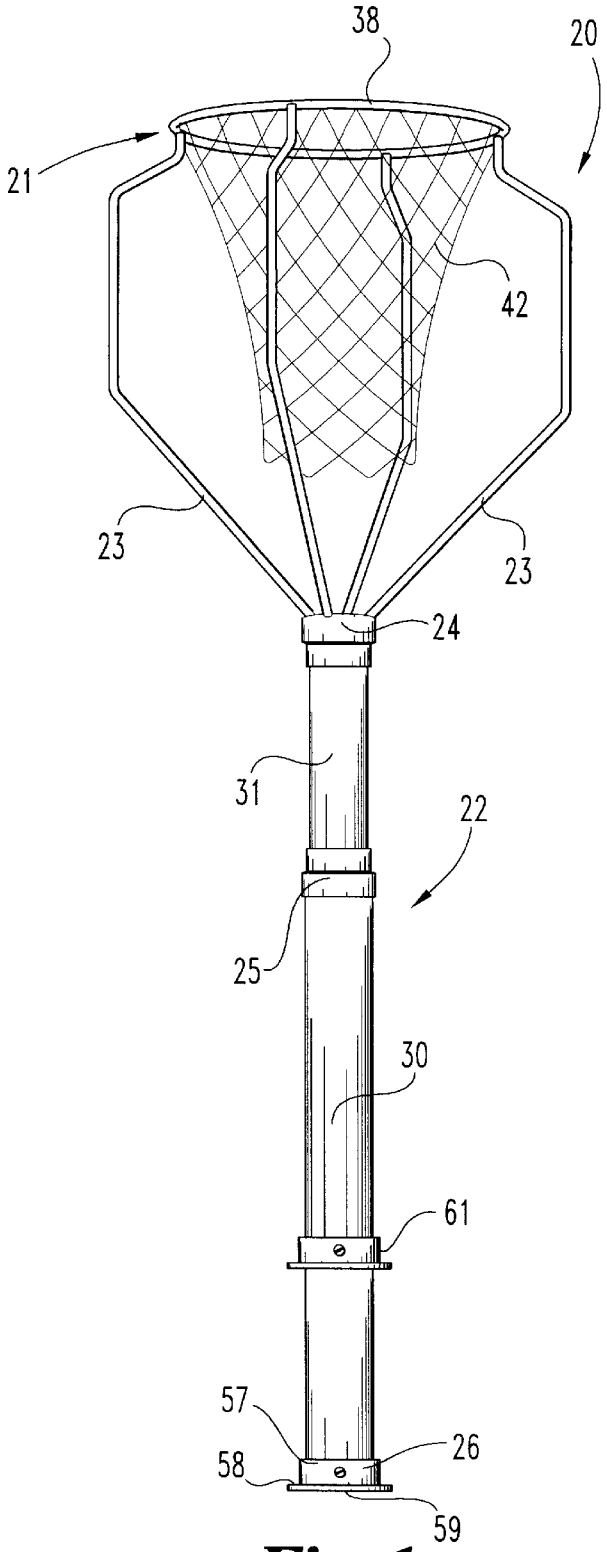
FIG. 1 is perspective view of a recreational device according to a typical embodiment of the present invention.

Referring to FIG. 1 there is illustrated a recreational device 20 which is designed according to the present invention. Device 20 includes a basket 21, support column 22, four support arms 23, adapter 24, adjustment ring 25, and base 26. An alternative base design for recreational device 20 is illustrated in FIG. 1A.

Figure 1B:
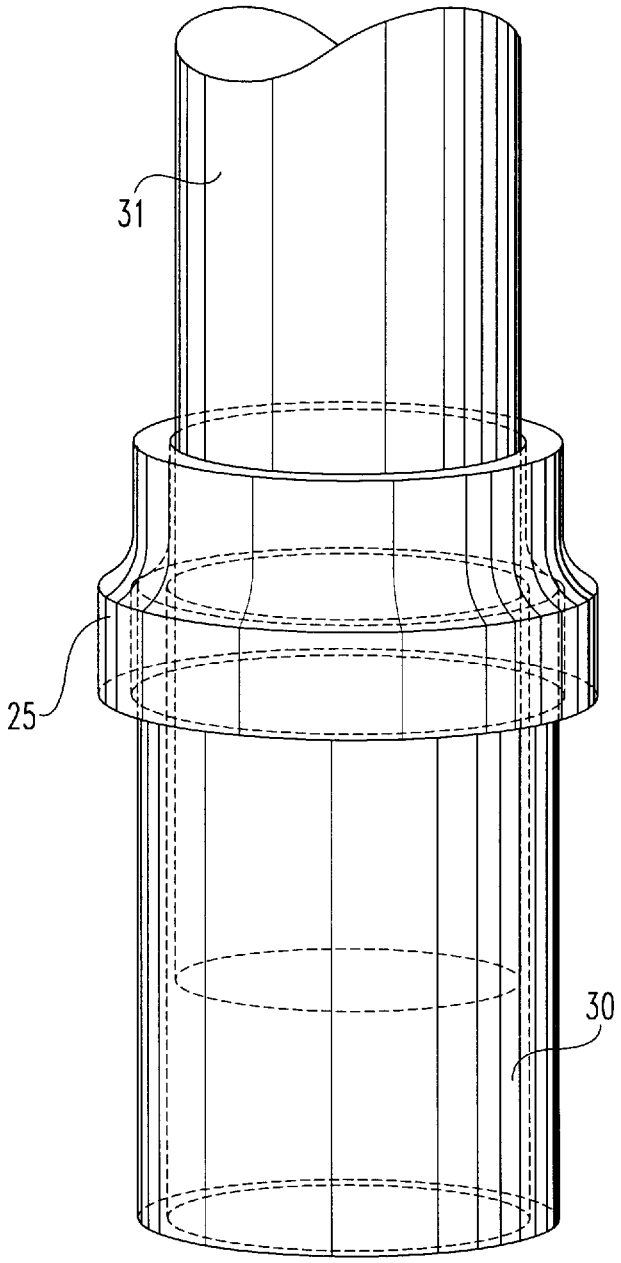
FIG. 1B is an enlarged, partial perspective view of a coupling for a support column which comprises one part of the FIG. 1 recreational device.

The support column 22 for recreational device 20, regardless of the base design, is configured in a telescoping manner with lower portion 30 positioned between base 26 and adjustment ring 25. The smaller inner portion 31 is slideably received within portion 30 so as to be able to selectively adjust the overall height of the support column 22 between adapter 24 and base 26. The adjustment ring 25 is threadedly received by lower portion 30 and functions like the leg adjustments on a tripod (see FIG. 1B). By turning the adjustment ring 25 in one direction, its hold on upper portion 31 is loosened, allowing portion 31 to be slideably moved, either in or out, with respect to portion 30. By turning the adjustment ring 25 in the other direction, the hold on portion 31 is tightened, thereby fixing the relationship between the two portions 30 and 31 and fixing the length of support column 20.

Figure 2:
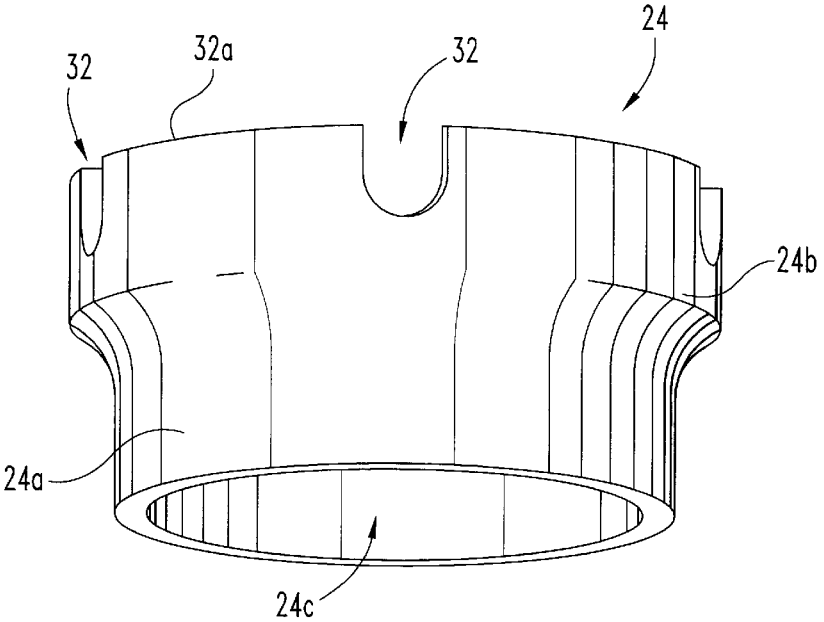
FIG. 2 is a perspective view of an adapter which comprises one part of the FIG. 1 recreational device.
Figure 4:
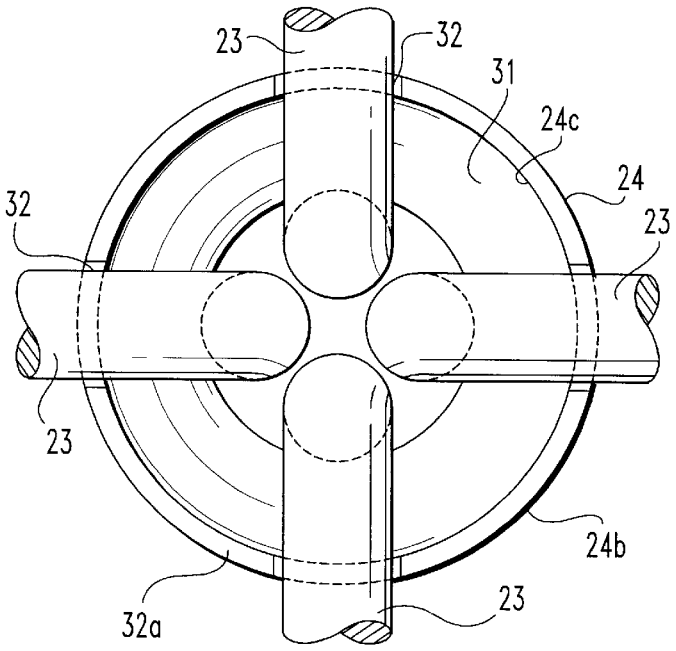
FIG. 4 is a partial top plan view of the assembly of four FIG. 3 support arms into the FIG. 2 adapter.

Adapter 24 (see FIG. 2) includes an annular collar 24*a* and a flared, annular portion 24*b*. Collar 24*a* is securely attached to the upper end of inner portion 31. Portion 24*b* is designed with four, equally-spaced channels 32 and a substantially flat top edge 32*a*. Each channel has a semicircular closed end, the diameter size being at least as large as the outside diameter of the corresponding support arm 23. The interior of portion 31 is hollow and adapter 24 has an annular ring shape such that the lower end 33 of each support arm 23 (see FIG. 3) is able to extend down through the hollow center 24*c* of adapter 24 and down into the interior of inner portion 31. A partial top plan view of the four support arms 23 and the manner in which they fit into the four channels 32 is provided by FIG. 4. The channels 32 are sized such that the fit of each arm 23 is designed with only a very slight clearance so that the arms 23 are effectively unable to move freely. Additionally, the diameter size of the hollow interior of the inner portion 31 is selected such that as the four arms 23 (actually the lower ends 33) are inserted therein in the cluster pattern of FIG. 4, the overall fit becomes relatively tight.

Figure 3:
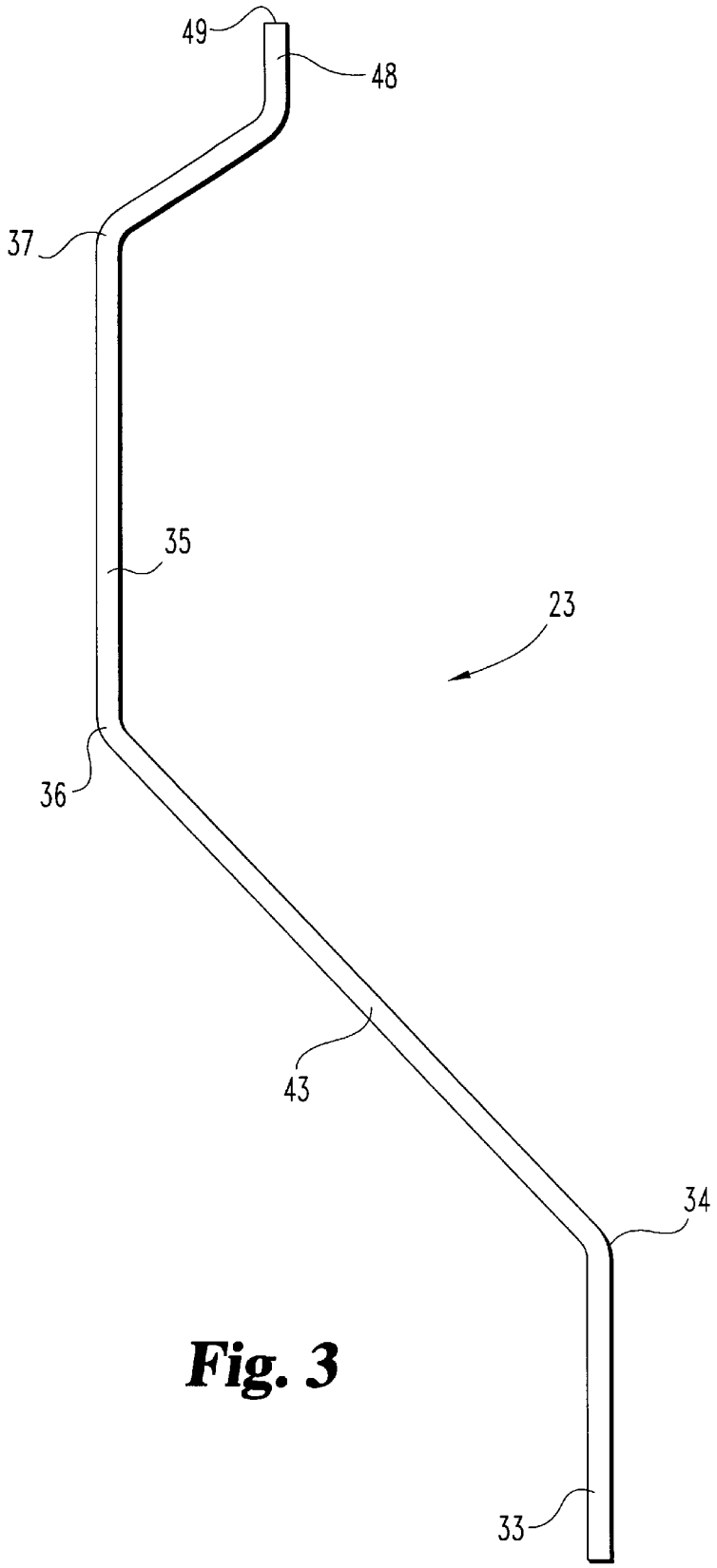
FIG. 3 is a front elevational view of a support arm which comprises one part of the FIG. 1 recreational device.

With reference to FIG. 3, the length of each lower end 33 is substantial so that each lower end extends well down into the inner portion 31 so as to establish a very secure and stable assembly. The first bend 34 of each arm 23 is located at the position of the channels 32 and from there, each support arm 23 extends upwardly and outwardly toward basket 21 as is illustrated in FIG. 1. The four sections 35 which are each bracketed by corresponding bends 36 and 37 are spaced radially outwardly beyond the outside diameter of rim 38 so that there is no interference with the ball dropping through the basket 21, including dropping through net 42. The diameter size represented by the equally-spaced pattern of the four sections 35 is large enough for the selected ball that will be used with recreational device 20 to fall through the net of the basket, but equally important is the spacing between adjacent sections 35. By increasing the diameter, the spacing between sections 35 is increased and this allows the selected ball to be removed or extracted from within the hollow "chamber" created by the four support arms. The bend angle and length of each section 43 are selected so that as the selected ball falls clear of the net 42 it is in effect funneled toward adapter 24. As the sections 43 come closer together as they extend toward bend 34, their circumferential spacing decreases and reaches a point where the spacing is too small for the ball to pass through. However, due to the momentum of the shot as the ball falls through the basket, it will normally bounce free of the device.

The basket includes rim 38 and net 42 which is generally connected to the rim in the conventional manner. The specific construction uses brass hooks which are screwed into the rim (PVC material) for attaching the net. The type of ball to be used with device 20 is optional, at least to some extent. Whether a basketball is used, a volleyball, or a soccerball, the most critical dimensional relationship is that the inside diameter of the rim 38 be large enough to readily receive the ball which is selected for use with device 20. As long as this minimum requirement is met, the sizing of the rim and ball can be selected depending on the difficulty which is desired. The closer the ball outside diameter to the rim inside diameter, the harder it will be to make the ball pass through the basket, putting a premium on the accuracy of the shot. The rim 38 is encased within a soft, pliable rubber layer for added safety. This rubber encasement covers the brass hooks and provides for a softer landing of a shot on the goal rim.

Figure 5:
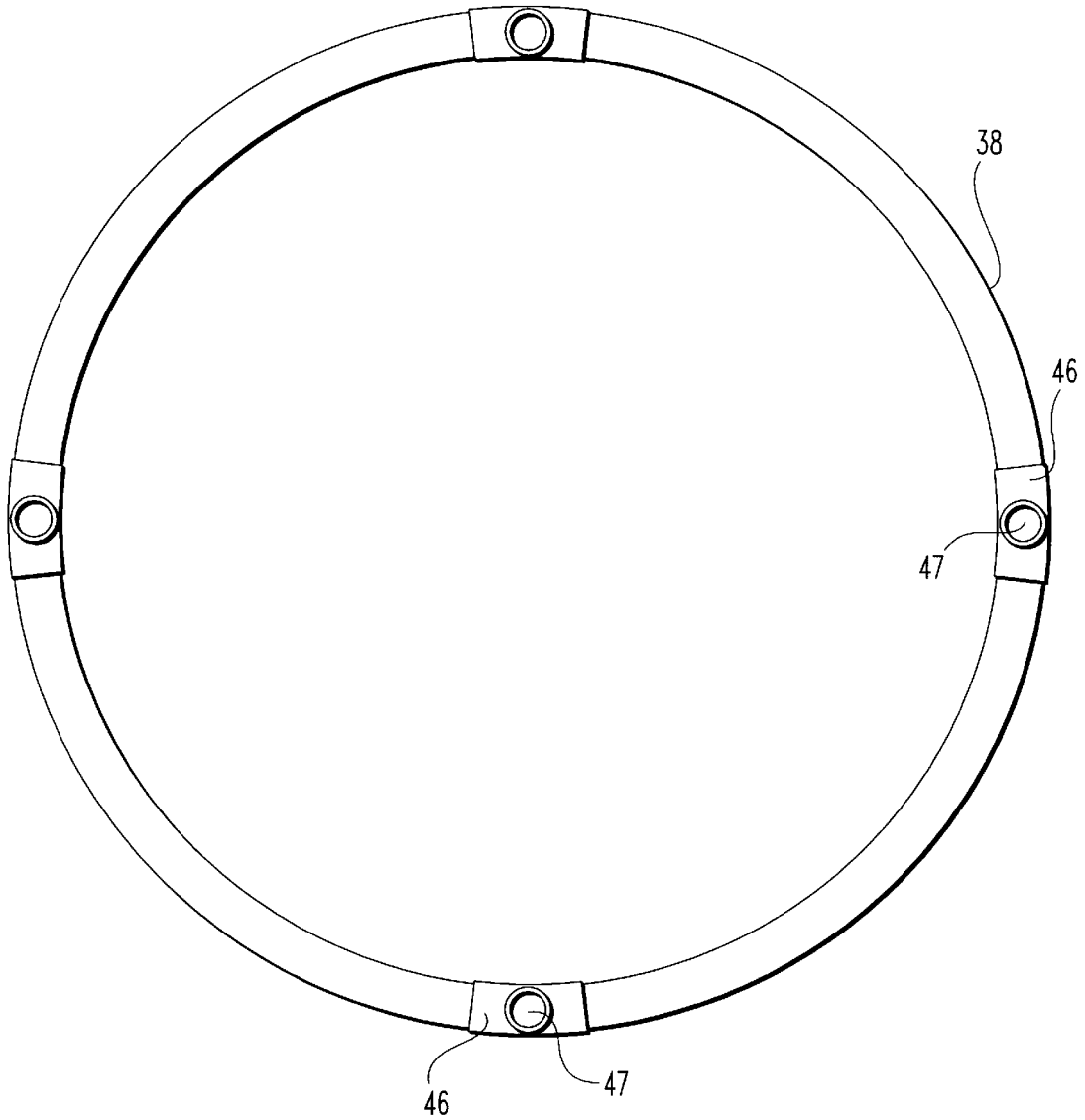
FIG. 5 is a bottom plan view of a basket rim comprising one part of the FIG. 1 recreational device according to the present invention.
Figure 6:
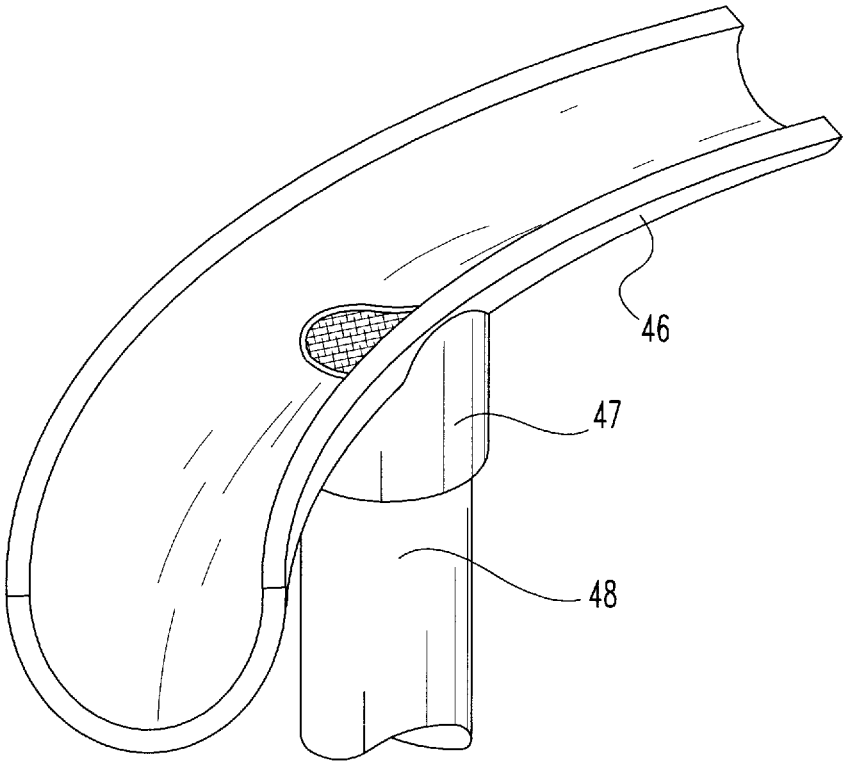
FIG. 6 is a partial, perspective view of a socket section comprising one part of the FIG. 5A basket rim according to the present invention.

With reference to FIGS. 5 and 6, the rim 38 is a circular, hollow hoop with four integral socket sections 46 which are each designed with a blind cylindrical socket 47 sized to receive the upper end 48 of a corresponding support arm 23. In the preferred embodiment, each section 46 and its corresponding socket 47 is a unitary combination. The hollow hoop of rim 38 is preferably constructed out of PVC tubing, or alternatively plastic or metal. The sizing between the upper end 48 and the blind cylindrical socket 47 is such that these two components assemble together with a sliding to light press fit. By pressing each end 48 into its corresponding socket 47, the basket 21 is assembled to the four support arms 23 as is illustrated in FIG. 1.

If the ends 33 of the support arms 23 are fully inserted into the hollow interior of inner portion 31, up to the point that bends 34 fit properly into channels 32, then the upper surface 49 of upper ends 48 of the arms 23 will be substantially coplanar. Then, so long as the ends 48 are inserted the same amount or to the same depth into their corresponding sockets 47, the rim will be substantially horizontal.

Rim 38 is preferably designed as a one-piece unit with the sockets 47 and socket sections 46 formed therein. A unitary molded design for rim 38 is preferred. As an alternative, a unitary hoop can be used for rim 38 with separate socket sections 46 (see FIG. 6) securely attached, such as by adhesive bonding or ultrasonic welding if plastic is used or by conventional welding if metal is used.

Figure 5A:
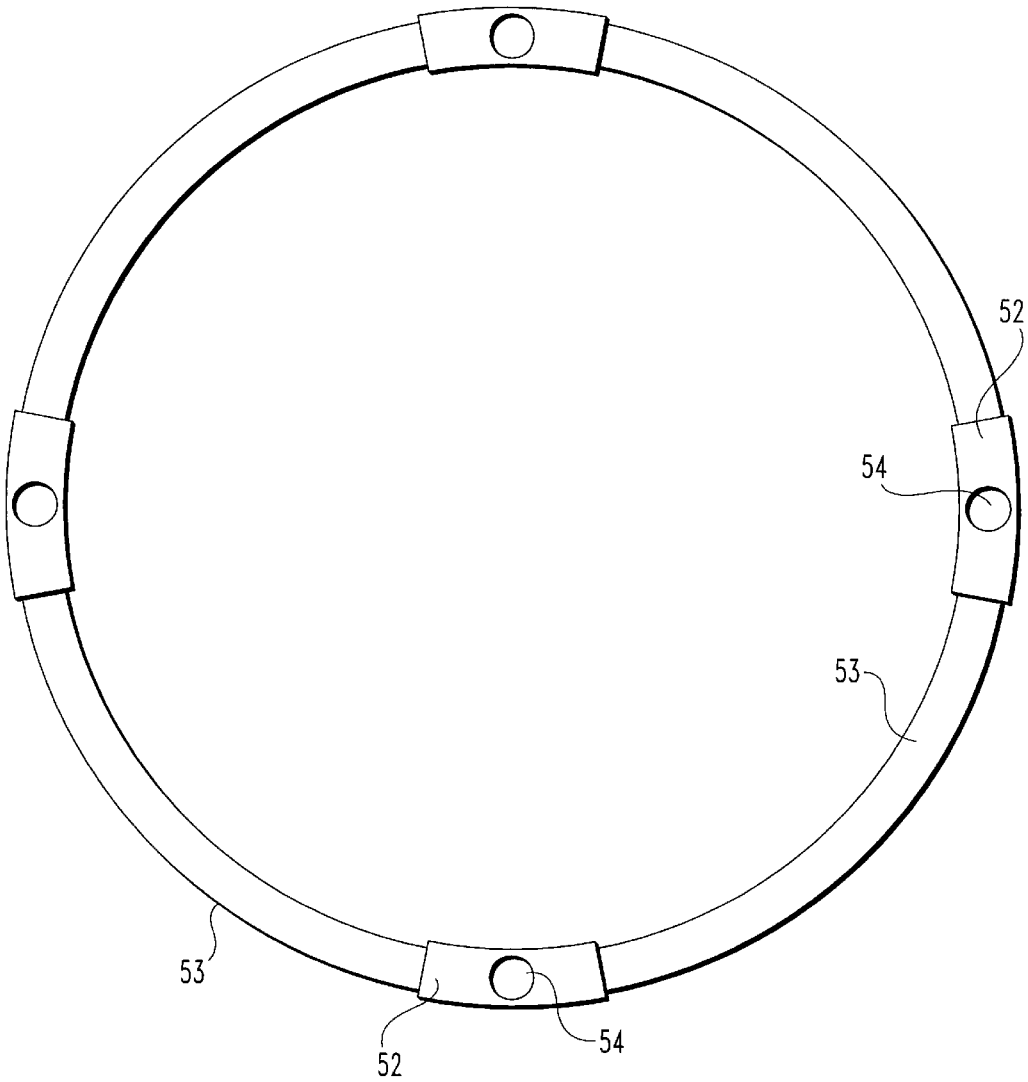
FIG. 5A is a bottom plan view of an alternative basket rim according to the present invention.

Another option for the rim (see FIG. 5A) is to form each of the four socket sections 52 as tubular sections open at each end and create the hoop portion by use of four arcuate sections 53 which insert at opposite ends into adjacent socket sections 52. The ends of the sockets 54 are preferably closed so as to provide a rigid stop or abutment by means of the blind hole for the upper ends 48. Alternatively, the sockets may be left open and provide a lip or notch on the outside surface of each upper end 48 in order to denote the stopping point on the insertion of each end into its corresponding socket 47.

Figure 7:
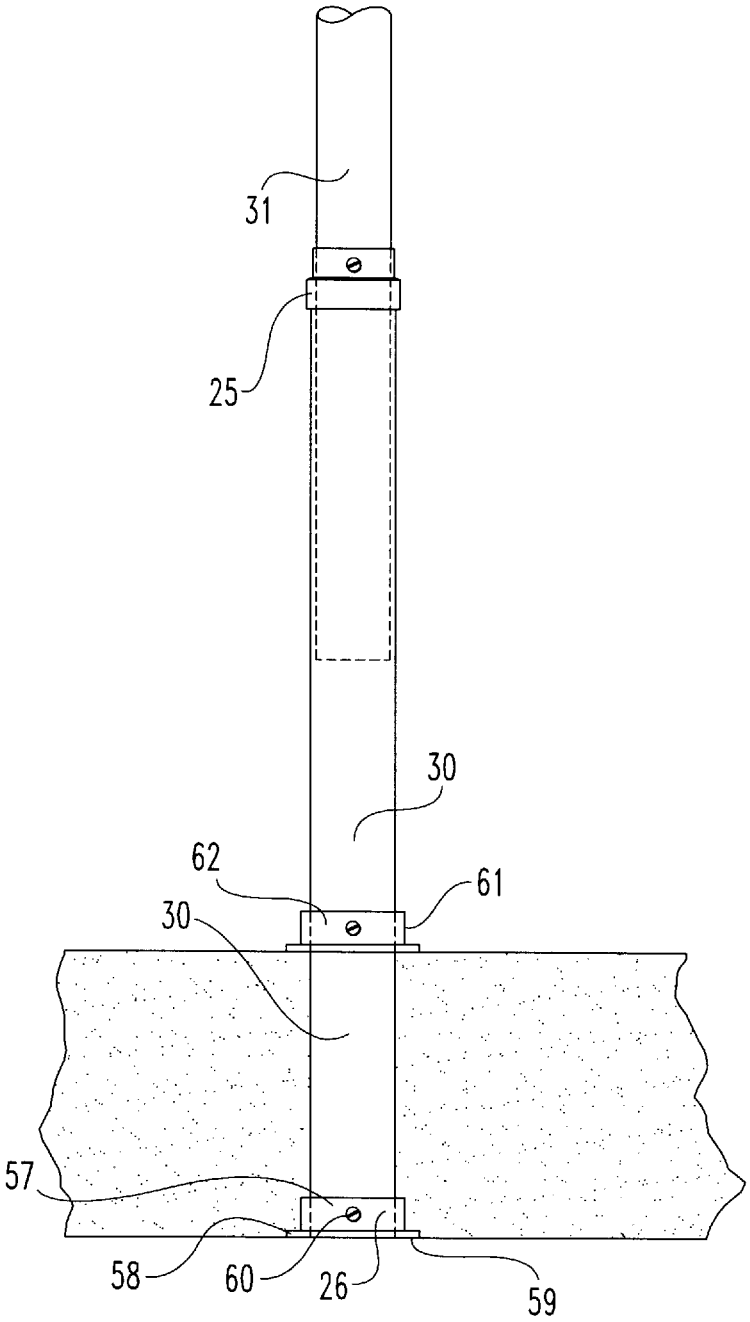
FIG. 7 is a partial, front elevational view of the FIG. 1 recreational device as installed into a soft surface.

The base 26 has a pedestal configuration with an upper annular socket 57 and a lower, enlarged circular flange 58 with a substantially flat lower surface 59. The socket 57 is sized and shaped to receive the lower end of lower portion 30 in a secure and rigid manner. At least one set screw 60 is used to additionally anchor lower portion 30 into socket 57. When the playing surface is sand or soil, (see FIGS. 1 and 7) a second "base" 61 is used and has a construction similar to base 26. Portion 30 extends through socket 62 and is pinned (set screw) to socket 62. The FIG. 7 illustration details how recreational device 20 is installed in sand or soil. A hole is dug and base 26 is set on the bottom surface of the hole. Next, the hole is filled in and packed with sand or soil. The location of base 62, which is slideably adjustable, is then set so as to rest firm only on the upper surface of the surrounding beach or ground. Flange 58 is sized in order to provide a stable support for the remainder of the device. With the use of plastic parts for device 20 and with a centered and symmetrical design, there is a substantial degree of balance inherent in the design of recreational device 20. This inherent balance enables a relatively easy task in the design of base 26 in order to provide the necessary support. The packed sand or soil anchors the base 26 in order to orient the support column 22 in an upright position. As an alternative design for soil, the flange of base 26 can include openings which would be suitable to receive anchoring stakes.

If the device 20 is used in a swimming pool, the base needs to be weighted down. One option is to use a larger (and heavier) metal base. Another option is to place a sandbag on the base to hold it to the floor of the pool.

Figure 8:
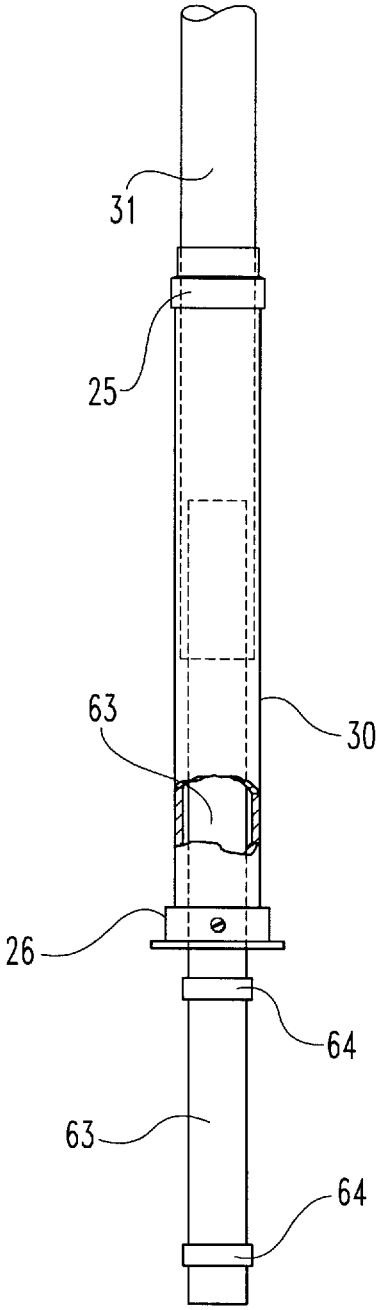
FIG. 8 is a partial, front elevational view of the FIG. 1 recreational device as installed into a hard surface.

When recreational device 20 is used on a hard surface, such as a paved driveway or playground or a wooden court such as a school gymnasium, a different anchoring design is appropriate. One option is to drill bolt holes into the hard surface with matching clearance holes in flange 58. Threaded inserts are then assembled into the bolt holes and threaded fasteners are used to clamp the flange 58 to the hard surface. Certain playgrounds and school gymnasiums will already have relatively deep drilled holes (bores) which are used to anchor tether ball stakes, volleyball net supports and the like. These holes can be utilized to support recreational device 20 as illustrated in FIG. 8. In order to utilize these existing holes, part of a separate support tube 63 is inserted through base 26 up into lower portion 30. The remaining part of the support tube 63 is inserted into the hole. Tube 63 may be pinned to flange 58 if the existing hole is too deep. If the existing hole is too large in diameter, it can be sleeved to reduce the diameter. Alternatively, collars 64 can be pinned to tube 63 to build up its outside diameter size for a closer fit.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A basketball-like game to be used in cooperation with a selected game ball for recreation, said game comprising:

a support assembly constructed and arranged for use in an upright orientation with a first end to be positioned adjacent ground level and a second, opposite end to be positioned at an elevated level above the ground level, said support assembly including a hollow lower portion and a support column telescopingly received within said lower portion, said support column defining a hollow interior;

a basketball-like goal having an annular hoop and a net, open at the bottom, attached to said annular hoop;

at least three support arms, each support arm having a connecting end which is assembled to said annular hoop and an opposite, inserted end which is received within said hollow interior; and an adapter attached to said support column, said adapter constructed and arranged with at least three channels, each support arm fitting within a corresponding one of said at least three channels for spacing and alignment of said corresponding support arms.

2. The basketball-like game of claim 1 wherein said at least three support arms are equally spaced apart from each other at said connecting ends and at said inserted ends.

3. The basketball-like game of claim 2 wherein said at least three channels are equally spaced from each other.

4. The basketball-like game of claim 3 wherein said annular hoop includes a plurality of receiving sockets, there being one receiving socket provided for each support arm, the connecting end of each support arm being fitted into a corresponding receiving socket.

* * * * *